US005651071A

United States Patent [19]

Lindemann et al.

[11] Patent Number: 5,651,071

[45] Date of Patent: Jul. 22, 1997

[54] NOISE REDUCTION SYSTEM FOR BINAURAL HEARING AID

[75] Inventors: Eric Lindemann; John Laurence Melanson, both of Boulder, Colo.

[73] Assignee: AudioLogic, Inc., Boulder, Colo.

[21] Appl. No.: 123,503

[22] Filed: Sep. 17, 1993

[51] Int. Cl.[6] ..... H04R 25/00

[52] U.S. Cl. ..... 381/68.2; 381/68.4; 395/2.35

[58] Field of Search ..... 381/68.2, 68, 68.4, 381/60, 26, 74, 94, 46, 47; 395/2.35, 2.12, 2.37, 2.42

[56] References Cited

U.S. PATENT DOCUMENTS

| | | | |
|---|---|---|---|
| 4,628,529 | 12/1986 | Borth et al. . | |
| 4,630,305 | 12/1986 | Borth et al. . | |
| 4,868,880 | 9/1989 | Bennett, Jr. . | |
| 4,887,299 | 12/1989 | Cummins et al. . | |
| 5,029,217 | 7/1991 | Chabries et al. . | |
| 5,341,452 | 8/1994 | Hall, II et al. | 395/2.35 |

OTHER PUBLICATIONS

"Multimicrophone Signal–Processing Technique to Remove Reverberation from Speech Signals" by J. Allen et al, vol. 62, No. 4, Oct. 1977, pp. 912–915.

"An Alternative Approach to Linearly Constrained Adaprive Beamforming" By L. J. Griffiths et al, IEEE Transactions, vol. AP–30, No. 1, Jan. 1982, pp. 27–34.

"Speech Enhancement Using A Minimum Mean–Square Error Short–Time Spectral Amplitude Estimator" By Y. Ephraim et al, IEE Transactions, Dec. 1984, No. 6.

Article Entitled "Extension of a Binaural Cross–Correlation Model by Contralateral Inhibition" By W. Lindemann, J. Acoust. Soc. Am. 80(6), Dec. 1986, pp. 1608–1622.

"Multimicrophone Adaptive Beamforming for Interference Reduction In Hearing Aids" by P. Peterson et al, Journal of Rehabilitation Research and Development, vol. 24, No. 4, pp. 103–110.

"Evaluation of Two Voice–Separation Algorithms Using Normal–Hearing and Hearing–Impaired Listeners" By R. Stubbs et al, J. Acoust. Soc., Oct. 1988.

"Improvement of Speech Intelligibility In Noise Development and Evaluation of a New Directional Hearing Instrument Based On Array Technology" By W. Soede, Delft Univ. of Technology.

Article Entitled "Evaluation of An Adaptive Beamforming Method for Hearing Aids" By J. Greenberg et al, J. Acoust. Soc. Am. 91 (3), Mar. 1992, pp. 1662–1676.

"Digital Signal Processing for Binaural Hearing Aids" By Kollmeier et al, Proceedings International Congress on Acoustics, 1992, Beijing, China.

Article Entitled "Cocktail–Party–Processing: Concept and Results" By M. Bodden, Bodden Proceedings, 1992, Beijing, China.

(List continued on next page.)

*Primary Examiner*—Curtis Kuntz
*Assistant Examiner*—Huyen D. Le
*Attorney, Agent, or Firm*—Homer L. Knearl; Holland & Hart

[57] ABSTRACT

In this invention noise in a binaural hearing aid is reduced by analyzing the left and right digital audio signals to produce left and right signal frequency domain vectors and thereafter using digital signal encoding techniques to produce a noise reduction gain vector. The gain vector can then be multiplied against the left and right signal vectors to produce a noise reduced left and right signal vector. The cues used in the digital encoding techniques include directionality, short term amplitude deviation from long term average, and pitch. In addition, a multidimensional gain function based on directionality estimate and amplitude deviation estimate is used that is more effective in noise reduction than simply summing the noise reduction results of directionality alone and amplitude deviations alone. As further features of the invention, the noise reduction is scaled based on pitch-estimates and based on voice detection.

14 Claims, 5 Drawing Sheets

OTHER PUBLICATIONS

"Microphone Array Speech Enhancement In Overdetermined Signal Scenarios" By R. Slyh et al., Proceedings IEEE International Conference on on Acoustics, Speech and Signal Processing, II–347–II–350.

"Separation of Speech from Interfering Speech By Means of Harmonic Selection" by T. Parsons, J. Acoust. Soc. Am., vol. 60, No. 4, Oct. 1976, pp. 911–918.

"Suppression of Acoustic Noise In Speech Using Spectral Subtraction" By S. Boll, IEEE Transactions on Acoustics, Speech and Signal Processing, vol. ASSP–27, No. 2, Apr. 1979, pp. 113–120.

NOTE: THIS CIRCUIT IS REPEATED FOR EVERY FREQUENCY F OF THE FFT

NOISE REDUCTION SYSTEM FOR BINAURAL HEARING AID

CROSS REFERENCE TO RELATED APPLICATIONS

The present invention relates to patent application entitled "Binaural Hearing Aid" Ser. No. 08/123,499, filed Sep. 17, 1993, which describes the system architecture of a hearing aid that uses the noise reduction system of the present invention.

BACKGROUND OF THE INVENTION

1. Field of the Invention:

This invention relates to binaural hearing aids, and more particularly, to a noise reduction system for use in a binaural hearing aid.

2. Description of Prior Art:

Noise reduction, as applied to hearing aids, means the attenuation of undesired signals and the amplification of desired signals. Desired signals are usually speech that the hearing aid user is trying to understand. Undesired signals can be any sounds in the environment which interfere with the principal speaker. These undesired sounds can be other speakers, restaurant clatter, music, traffic noise, etc. There have been three main areas of research in noise reduction as applied to hearing aids: directional beamforming, spectral subtraction, pitch-based speech enhancement.

The purpose of beamforming in a hearing aid is to create an illusion of "tunnel hearing" in which the listener hears what he is looking at but does not hear sounds which are coming from other directions. If he looks in the direction of a desired sound—e.g., someone he is speaking to—then other distracting sounds—e.g., other speakers—will be attenuated. A beamformer then separates the desired "on-axis" (line of sight) target signal from the undesired "off-axis" jammer signals so that the target can be amplified while the jammer is attenuated.

Researchers have attempted to use beamforming to improve signal-to-noise ratio for hearing aids for a number of years {References 1, 2, 3, 7, 8, 9}. Three main approaches have been proposed. The simplest approach is to use purely analog delay and sum techniques {2}. A more sophisticated approach uses adaptive FIR filter techniques using algorithms, such as the Griffiths-Jim beamformer {1, 3}. These adaptive filter techniques require digital signal processing and were originally developed in the context of antenna array beamforming for radar applications {5}. Still another approach is motivated from a model of the human binaural hearing system {14, 15}. While the first two approaches are time domain approaches, this last approach is a frequency domain approach.

There have been a number of problems associated with all of these approaches to beamforming. The delay-and-sum and adaptive filter approaches have tended to break down in non-anechoic, reverberant listening situations: any real room will have so many acoustic reflections coming off walls and ceilings that the adaptive filters will be largely unable to distinguish between desired sounds coming from the front and undesired sounds coming from other directions. The delay-and-sum and adaptive filter techniques have also required a large (>=8) number of microphone sensors to be effective. This has made it difficult to incorporate these systems into practical hearing aid packages. One package that has been proposed consists of a microphone array across the top of eyeglasses {2}.

The frequency domain approaches which have been proposed {7, 8, 9} have performed better than delay-and-sum or adaptive filter approaches in reverberant listening environments and function with only two microphones. The problems related to the previously-published frequency domain approaches have included unacceptably long input-to-output time delay, distortion of the desired signal, spatial aliasing at high frequencies, and some difficulty in reverberant environments (although less than for the adaptive filter case).

While beamforming uses directionality to separate desired signal from undesired signal, spectral subtraction makes assumptions about the differences in statistics of the undesired signal and the desired signal, and uses these differences to separate and attenuate the undesired signal. The undesired signal is assumed to be lower in amplitude then the desired signal and/or has a less time varying spectrum. If the spectrum is static compared to the desired signal (speech), then a long-term estimation of the spectrum will approximate the spectrum of the undesired signal. This spectrum can be attenuated. If the desired speech spectrum is most often greater in amplitude and/or uncorrelated with the undesired spectrum, then it will pass through the system relatively undistorted despite attenuation of the undesired spectrum. Examples of work in spectral subtraction include references {11, 12, 13}.

Pitch-based speech enhancement algorithms use the pitched nature of voiced speech to attempt to extract a voice which is embedded in noise. A pitch analysis is made on the noisy signal. If a strong pitch is detected, indicating strong voiced speech superimposed on the noise, then the pitch can be used to extract harmonics of the voiced speech, removing most of the uncorrelated noise components. Examples of work in pitch-based enhancement are references {17, 18}.

SUMMARY OF THE INVENTION

In accordance with this invention, the above problems are solved by analyzing the left and right digital audio signals to produce left and right signal frequency domain vectors and, thereafter, using digital signal encoding techniques to produce a noise reduction gain vector. The gain vector can then be multiplied against the left and right signal vectors to produce a noise reduced left and right signal vector. The cues used in the digital encoding techniques include directionality, short-term amplitude deviation from long-term average, and pitch. In addition, a multidimensional gain function, based on directionality estimate and amplitude deviation estimate, is used that is more effective in noise reduction than simply summing the noise reduction results of directionality alone and amplitude deviations alone. As further features of the invention, the noise reduction is scaled based on pitch-estimates and based on voice detection.

Other advantages and features of the invention will be understood by those of ordinary skill in the art after referring to the complete written description of the preferred embodiments in conjunction with the following drawings.

DESCRIPTION OF THE PREFERRED EMBODIMENTS

Theory of Operation:

In the noise-reduction system described in this invention, all three noise reduction techniques, beamforming, spectral subtraction and pitch enhancement, are used. Innovations will be described relevant to the individual techniques, especially beamforming. In addition, it will be demonstrated that a synergy exists between these techniques such that the whole is greater than the sum of the parts.

Multidimensional Noise Reduction:

We call a multidimensional noise reduction system any system which uses two or more distinct cues generated from signal analysis to attempt to separate desired from undesired signal. In our case, we use three cues: directionality (D), short term amplitude deviation from long term average (STAD), and pitch (f0). Each of these cues has been used separately to design noise reduction systems, but the cooperative use of the cues taken together in a single system has not been done.

To see the interactions between the cues assume a system which uses D and STAD separately, i.e., the use of D alone as a beamformer and STAD alone as a spectral subtractor. In the case, of the beamformer we estimate D and then specify a gain function of D which is unity for high D and tends to zero for low D. Similarly, for the spectral subtractor we estimate STAD and provide a gain function of STAD which is unity for high STAD and tends to zero for low STAD.

Figure 5A:
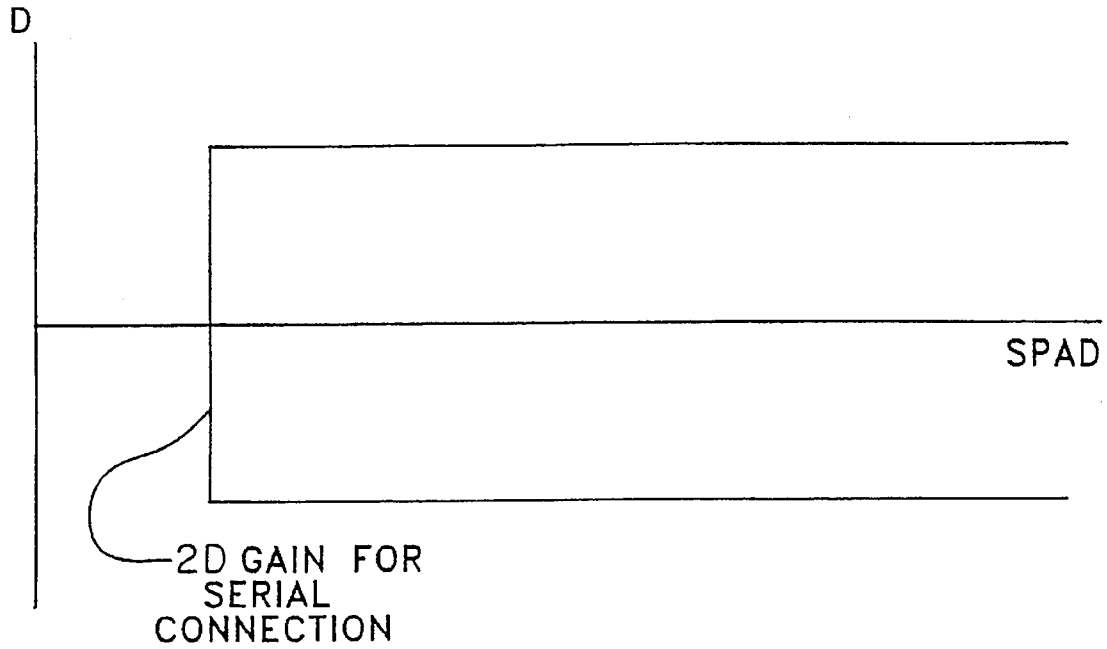
FIG. 5A is a graph of noise reduction gains as a serial function of directionality and spectral subtraction.

The two noise reduction systems can be connected back to back in serial fashion (e.g., beamformer followed by spectral subtractor). In this case, we can think in terms of a two-dimensional gain function of (D,STAD) with the function having a shape similar to that shown in FIG. 5A. With the serial connection, the gain function in FIG. 5A is rectangular. Values of (D,STAD) inside the rectangle generate a gain near unity which tends toward zero near the boundaries of the rectangle.

Figure 5B:
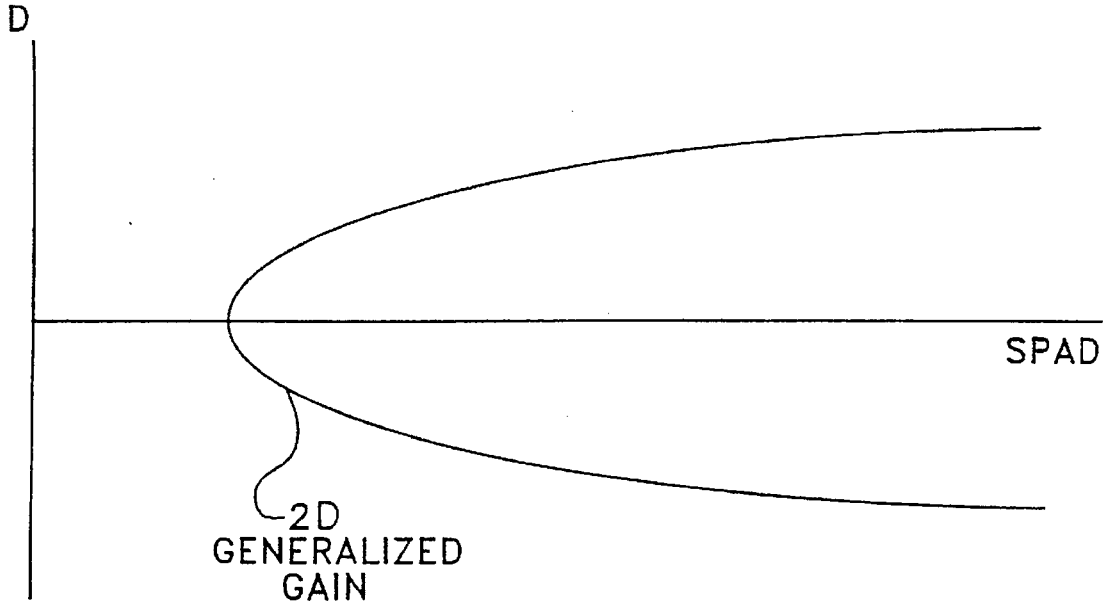
FIG. 5B is a graph of the noise reduction gain as a function of directionality estimate and spectral subtraction excursion estimate in accordance with the process in FIG. 4.

If we abandon the notion of a serial connection (beamformer followed by spectral subtractor) and instead think in terms of a general two-dimensional function of (D,STAD), then we can define non-rectangular gain contours, such as that shown in FIG. 5B Generalized Gain. Here we see that there is more interaction between the D and STAD values. A region which may have been included in the rectangular gain contour is now excluded because we are better able to take into consideration both D and STAD.

A common problem in spectral subtraction noise reduction systems is musical noise . This is isolated bits of spectrum which manage to rise above the STAD threshold in discrete bursts. This can turn a steady state noise, such as a fan noise, into a fluttering random musical note generator. By using the combination of (D,STAD) we are able to make a better decision about a spectral component by insisting that not only must it rise above the STAD threshold, but it must also be reasonably on-line. There is a continuous give and take between these two parameters.

Including f0, pitch, as a third cue gives rise to a three dimensional noise reduction system. We found it advantageous to estimate D and STAD in parallel and then use the two parameters in a single two-dimensional function for gain. We do not want to estimate f0 in parallel with D and STAD, though, because we can do a better estimate of f0 if we first noise reduce the signal somewhat using D and STAD. Therefore, based on the partially noise-reduced signal, we estimate f0 and then calculate the final gain using D, STAD and f0 in a general three-dimensional function, or we can use f0 to adjust the gain produced from D,STAD estimates. When f0 is included, we see that not only is the system more efficient because we can use arbitrary gain functions of three parameters, but also the presence of a first stage of noise reduction makes the subsequent f0 estimation more robust than it would be in an f0 only based system.

The D estimate is based on values of phase angle and magnitude for the current input segment. The STAD estimate is based on the sum of magnitudes over many past segments. A more general approach would make a single unified estimate based on current and past values of both phase angle and magnitude. More information would be used, the function would be more general, and so a better result would be had.

Frequency Domain Beamforming:

A frequency domain beamformer is a kind of analysis/synthesis system. The incoming signals are analyzed by transforming to the frequency (or frequency-like) domain. Operations are carried out on the signals in the frequency domain, and then the signals are resynthesized by transforming them back to the time domain. In the case of two microphone beamformers, the two signals are the left and right ear signals. Once transformed to the frequency domain, a directionality estimate can be made at each frequency point by comparing left and right values at each frequency. The directionality estimate is then used to generate a gain which is applied to the corresponding left and right frequency points and then the signals are resynthesized.

There are several key issues involved in the design of the basic analysis/synthesis system. In general, the analysis/synthesis system will treat the incoming signals as consecutive (possibly time overlapped) time segments of N sample points. Each N sample point segment will be transformed to produce a fixed length block of frequency domain coefficients. An optimum transform concentrates the most signal power in the smallest percentage of frequency domain coefficients. Optimum and near optimum transforms have been widely studied in signal coding applications {reference 19} where the desire is to transmit a signal using the fewest coefficients to achieve the lowest data rate. If most of the signal power is concentrated in a few coefficients, then only those coefficients need to be coded with high accuracy, and the others can be crudely coded or not coded at all.

The optimum transform is also extremely important for the beamformer. Assume that a signal consists of desired signal plus undesired noise signal. When the signal is transformed, some of the frequency domain coefficients will correspond largely to desired signal, some to undesired signal, and some to both. For the frequency coefficients with substantial contributions from both desired signal and noise, it is difficult to determine an appropriate gain. For frequency coefficients corresponding largely to desired signals the gain is near unity. For frequency coefficients corresponding largely to noise, the gain is near zero. For dynamic signals, such as speech, the distribution of energy across frequency coefficients from input segment to input segment can be regarded as random except for possibly a long-term global spectral envelope. Two signals, desired signal and noise, generate two random distributions across frequency coefficients. The value of a particular frequency coefficient is the sum of the contribution from both signals. Since the total number of frequency coefficients is fixed, the probability of two signals making substantial contributions to the same frequency coefficient increases as the number of frequency coefficients with substantial energy used to code each signal increases. Therefore, an optimum transform, which concentrates energy in the smallest percentage of the total coefficients, will result in the smallest probability of overlap between coefficients of the desired signal and noise signal. This, in turn, results in the highest probability of correct answers in the beamformer gain estimation.

A different view of the analysis/synthesis system is as a multiband filter bank {20}. In this case, each frequency coefficient, as it varies in time from input segment to input segment, is seen as the output of a bandpass filter. There are as many bandpass filters, adjacent in frequency, as there are frequency coefficients. To achieve high energy concentration in frequency coefficients we want sharp transition bands between bandpass filters. For speech signals, optimum transforms correspond to filter banks with relatively sharp transition bands to minimize overlap between bands.

In general, to achieve good discrimination between desired signal and noise, we want many frequency coefficients (or many bands of filtering) with energy concentrated in as few coefficients as possible (sharp transition bands between bandpass filters). Unfortunately, this kind of high frequency resolution implies large input sample segments which, in turn, implies long input to output delays in the system. In a hearing aid application, time delay through the system is an important parameter to optimize. If the time delay from input to output becomes too large (e.g.>about 40 ms), the lips of speakers are no longer synchronized with sound. It also becomes difficult to speak since the sound of one's one voice is not synchronized with muscle movements. The impression is unnatural and fatiguing. A compromise must be made between input-output delay and frequency resolution. A good choice of analysis/synthesis architecture can ease the constraints on this compromise.

Another important consideration in the design of analysis/synthesis systems is edge effects. These are discontinuities that occur between adjacent output segments. These edge effects can be due to the circular convolution nature of fourier transform and inverse transforms, or they can be due to abrupt changes in frequency domain filtering (noise reduction gain, for example) from one segment to the next. Edge effects can sound like fluttering at the input segment rate. A well-designed analysis/synthesis system will eliminate these edge effects or reduce them to the point where they are inaudible.

The theoretical optimum transform for a signal of known statistics is the Karhoenen-Loeve Transform or KLT {19}. The KLT does not generally lend itself to practical implementation, but serves as a basis for measuring the effectiveness of other transforms. It has been shown that, for speech signals, various transforms approach the KLT in effectiveness. These include the DCT {19}, and ELT {21}. A large body of literature also exists for designing efficient filter banks {22, 23}. This literature also proposes techniques for eliminating or reducing edge effects.

One common design for analysis/synthesis systems is based on a technique called overlap-add {16}. In the overlap-add scheme, the incoming time domain signals are segmented into N point non-overlapping, adjacent time segments. Each N point segment is "padded" with an additional L zero values. Then each N+L point "augmented" segment is transformed using the FFT. A frequency domain gain, which can be viewed as the FFT of another N+L point sequence consisting an M point time domain finite impulse response padded with N+L−M zeros, is multiplied with the transformed "augmented" input segment, and the product is inverse transformed to generate an N+L point time domain sequence. As long as M<L, then the resulting N+L point time domain sequence will have no circular convolution components. Since an N+L point segment is generated for each incoming N point segment, the resulting segments will overlap in time. If the overlapping regions of consecutive segments are summed, then the result is equivalent to a linear convolution of the input signal with the gain impulse response.

There are a number of problems associated with the overlap-add scheme. Viewed from the point of view of filter bank analysis, an overlap/add scheme uses bandpass filters whose frequency response is the transform of a rectangular window. This results in a poor quality bandpass response with considerable leakage between bands so the coefficient energy concentration is poor. While an overlap-add scheme will guarantee smooth reconstruction in the case of convolution with a stationary finite impulse response of constrained length, when the impulse response is changing every block time, as is the case when we generate adaptive gains for a beamformer, then discontinuities will be generated in the output. It is as if we were to abruptly change all the coefficients in an FIR filter every block time. In an overlap-add system, the input to output minimum delay is:

$$D_{overlap_add}=(1+Z/2) * N+(\text{compute time for } 2*N \text{ FFT})$$

Where:

N=input segment length,

Z=number of zeros added to each block for zero padding.

A minimum value for Z is N, but this can easily be greater if the gain function is not sufficiently smooth over frequency. The frequency resolution of this system is N/2 frequency bins given conjugate symmetry of the transforms of the real input signal, and the fact that zero padding results in an interpolation of the frequency points with no new information added.

In the system design described in the preferred embodiments section of this patent, we use a windowed analysis/synthesis architecture. In a windowed FFT analysis/synthesis system, the input and output time domain sample segments are multiplied by a window function which in the preferred embodiment is a sine window for both the input and output segments. The frequency response of the bandpass filters (the transform of the sine window) is more sharply bandpass than in the case of the rectangular windows of the overlap-add scheme so there is better coefficient energy concentration. The presence of the synthesis window results in an effective interpolation of the adaptive gain coefficients from one segment to the next and so reduces edge effects. The input to output delay for a windowed system is:

$$D_{window}=1 * N+(\text{compute time for } N \text{ FFT})$$

Where:

N=input segment length.

It is clear that the sine windowed system is preferable to the overlap-add system from the point of view of coefficient energy concentration, output smoothness, and input-output delay. Other analysis/synthesis architectures, such as ELT, Paraunitary Filter Banks, QMF Filter Banks, Wavelets, DCT should provide similar performance in terms of input-output delay but can be superior to the sine window architecture in terms of energy concentration, and reduction of edge effects.

Figure 1:
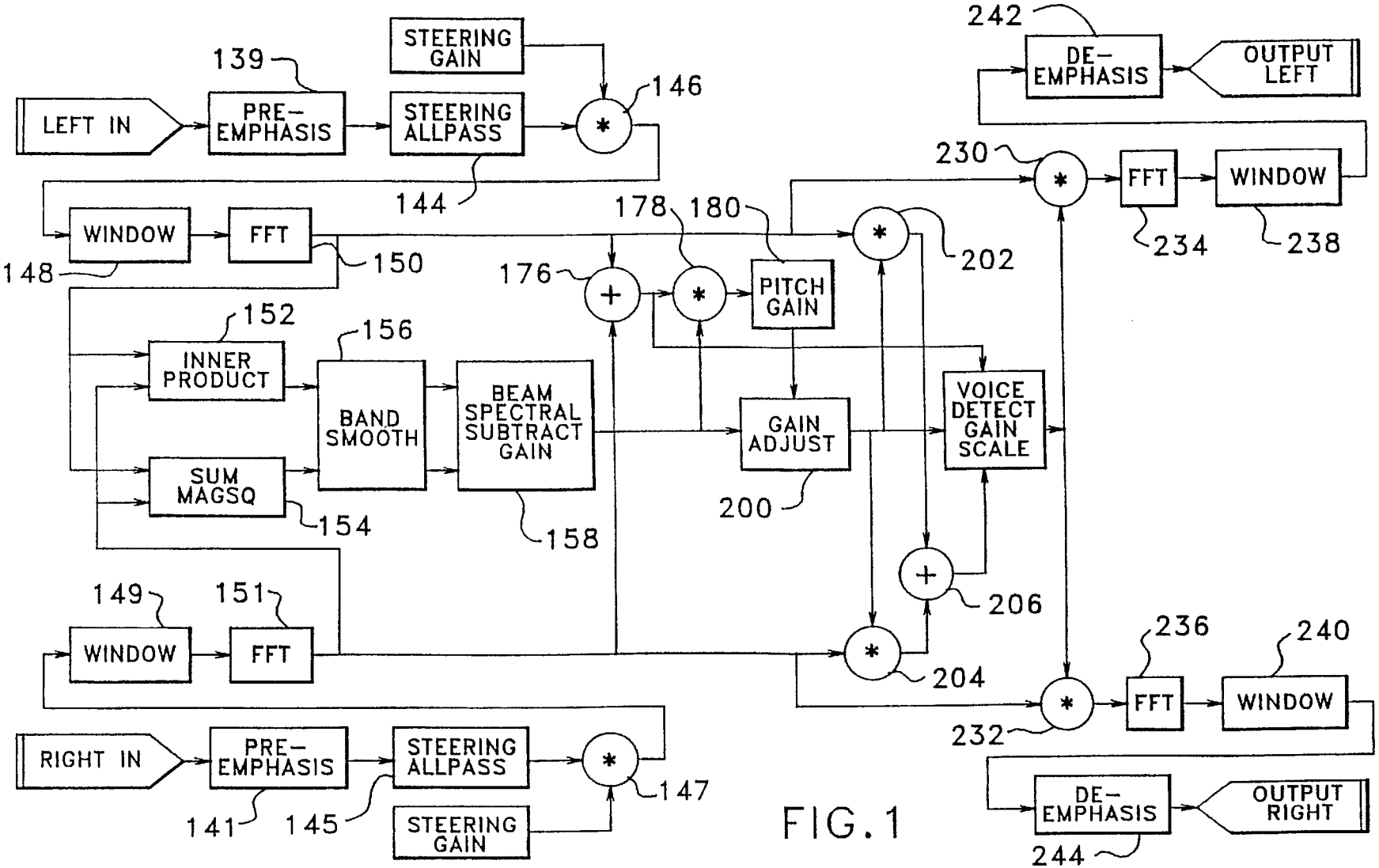
FIG. 1 illustrates the preferred embodiment of the noise reduction system for a binaural hearing aid.

Preferred Embodiment:

In FIG. 1, the noise reduction stage, which is implemented as a DSP software program, is shown as an operations flow diagram. The left and right ear microphone signals have been digitized at the system sample rate which is generally adjustable in a range from $F_{SAMP}$=8–48 kHz, but has a nominal value of Fsamp 11.025 Khz sampling rate. The left and right audio signals have little, or no, phase or magnitude distortion. A hearing aid system for providing such low distortion left and right audio signals is described in the above-identified cross-referenced patent application entitled "Binaural Hearing Aid." The time domain digital input signal from each ear is passed to one-zero pre-emphasis filters 139, 141. Pre-emphasis of the left and right ear signals using a simple one-zero high-pass differentiator pre-whitens the signals before they are transformed to the frequency domain. This results in reduced variance between frequency coefficients so that there are fewer problems with numerical error in the Fourier transformation process. The effects of the preemphasis filters 139, 141 are removed after inverse Fourier transformation by using one-pole integrator deemphasis filters 242 and 244 on the left and right signals at the end of noise reduction processing. Of course, if binaural compression follows the noise reduction stage of processing, the inverse transformation and deemphasis would be at the end of binaural compression.

In FIG. 1, after preemphasis, if used, the left and right time domain audio signals are passed through allpass filters 144, 145 to gain multipliers 146, 147. The allpass filter serves as a variable delay. The combination of variable delay and gain allows the direction of the beam in beam forming to be steered to any angle if desired. Thus, the on-axis direction of beam forming may be steered from something other than straight in front of the user, or may be tuned to compensate for microphone or other mechanical mismatches.

At times, it may be desirable to provide maximum gain for signals appearing to be off-axis, as determined from analysis of left and right ear signals. This may be necessary to calibrate a system which has imbalances in the left and right audio chain, such as imbalances between the two microphones. It may also be desirable to focus a beam in another direction then straight ahead. This may be true when a listener is riding in a car and wants to listen to someone sitting next to him without turning in that direction. It may also be desirable for non-hearing aid applications, such as speaker phones or hands-free car phones. To accomplish this beam steering, a delay and gain are inserted in one of the time domain input signal paths. This tunes the beam for a particular direction.

The noise reduction operation in FIG. 1 is performed on N point blocks. The choice of N is a trade-off between frequency resolution and delay in the system. It is also a function of the selected sample rate. For the nominal 11.025 sample rate, a value of N=256 has been used. Therefore, the signal is processed in 256 point consecutive sample blocks. After each block is processed, the block origin is advanced by 128 points. So, if the first block spans samples 0..255 of both the left and right channels, then the second block spans samples 128..383, the third spans samples 256..511, etc. The processing of each consecutive block is identical.

The noise reduction processing begins by multiplying the left and right 256 point sample blocks by a sine window in operations 148, 149. A fast Fourier transform (FFT) operation 150, 151 is then performed on the left and right blocks. Since the signals are real, this yields a 128 point complex frequency vector for both the left and right audio channels. The elements of the complex frequency vectors will be referred to as bin values. So there are 128 frequency bins from F=0 (DC) to F×Fsamp/2 Khz.

Figure 2:
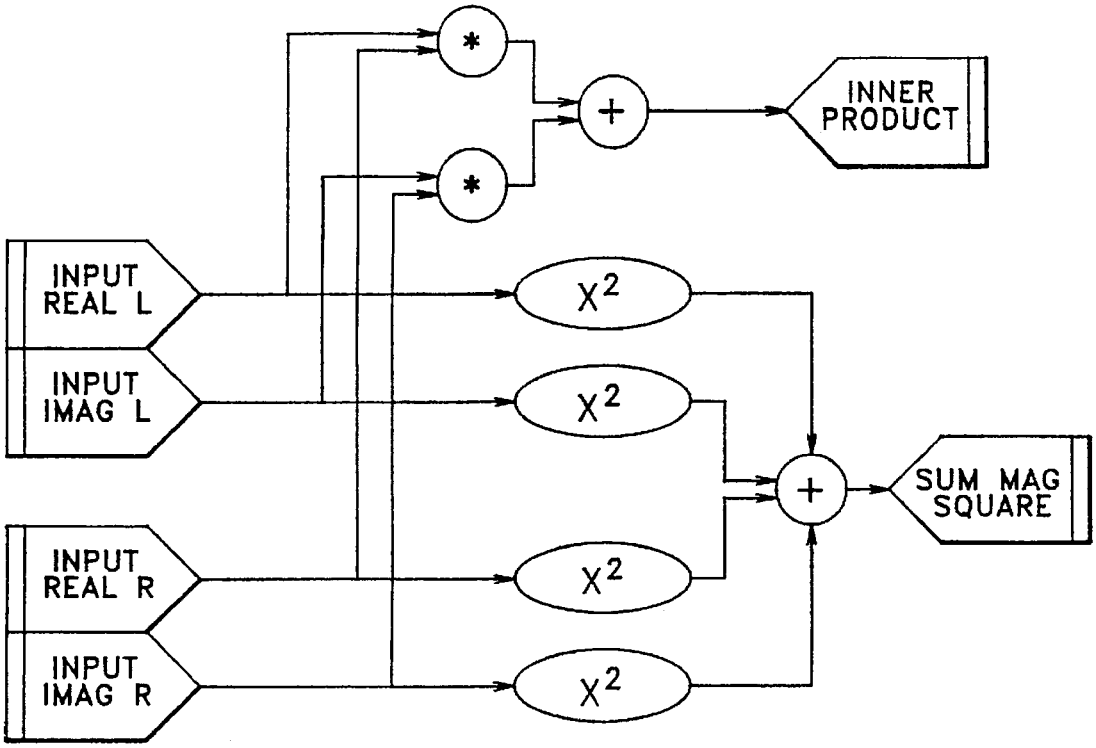
FIG. 2 shows the details of the inner product operation and the sum of magnitudes squared operation referred to in FIG. 1.

The inner product of, and the sum of magnitude squares of each frequency bin for the left and right channel complex frequency vector, is calculated by operations 152 and 154, respectively. The expression for the inner product is:

```
Inner Product(k)=Real(Left(k))*Real(Right(k))+
    Imag(Left(k))*Imag(Right(k)
```

and is implemented, as shown in FIG. 2. The operation flow in FIG. 2 is repeated for each frequency bin. On the same FIG. 2, the sum of magnitude squares is calculated as:

```
Magnitude Squared Sum(k)=Real(Left(k))^2+Real(Right(k))^2+
    Imag(Left(k))^2+Imag(Right(k)^2.
```

An inner product and magnitude squared sum are calculated for each frequency bin forming two frequency domain vectors. The inner product and magnitude squared sum vectors are input to the band smooth processing operation 156. The details of the band smoothing operation 156 are shown in FIG. 3.

Figure 3A:
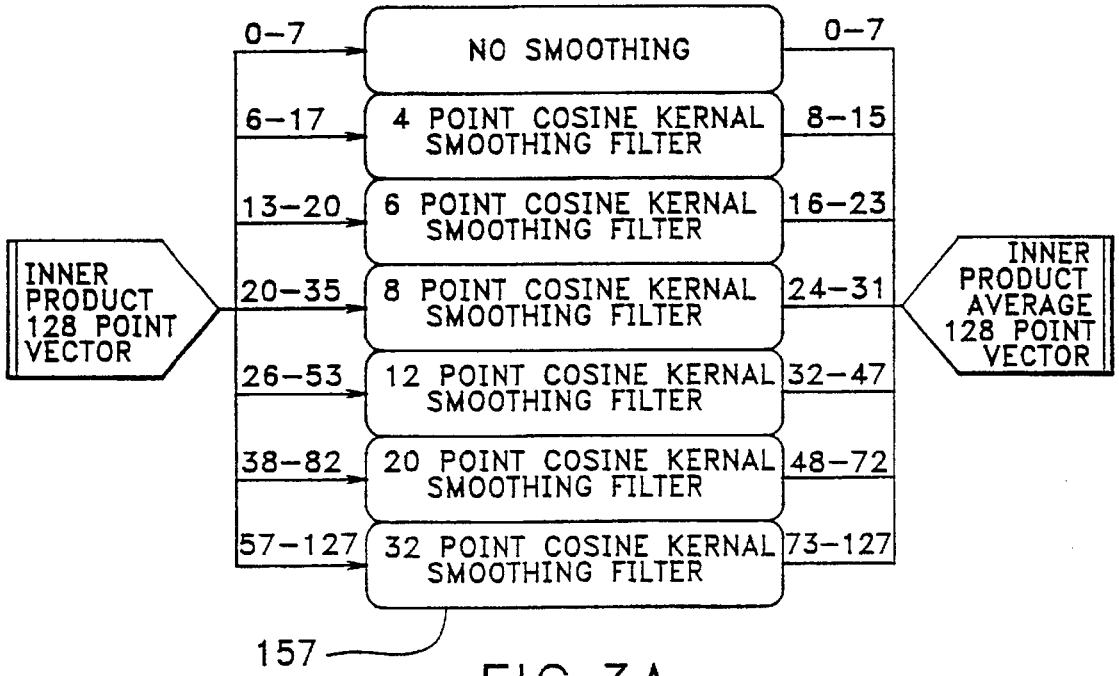
FIGS. 3A and 3B show the band smoothing filters 157 of band smoothing operation 156 in FIG. 1.
Figure 3B:
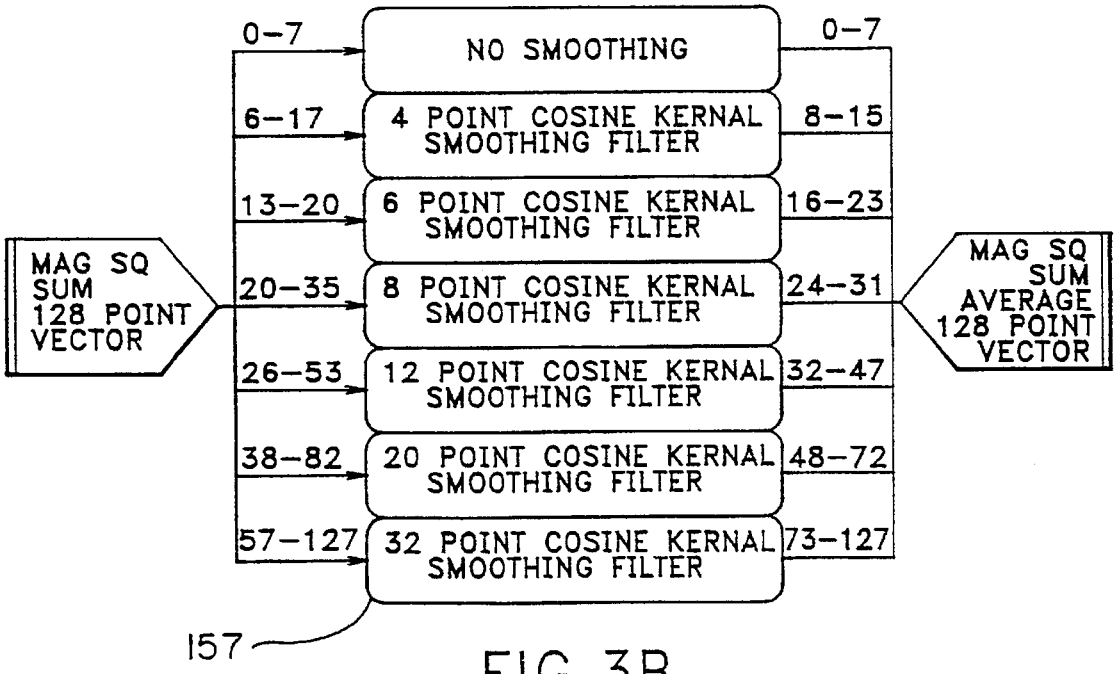

In FIGS. 3A and 3B, the inner product vector and the magnitude square sum vector are 128 point frequency domain vectors. The small numbers on the input lines to the smoothing filters 157 indicate the range of indices in the vector needed for that smoothing filter. For example, the top-most filter (no smoothing) for either average has input indices 0 to 7. The small numbers on the output lines of each smoothing filter indicate the range of vector indices output by that filter. For example, the bottom most filter for either average has output indices 73 to 127.

As a result of band smoothing operation 156, the vectors are averaged over frequency according to:

```
Inner Product Averaged(k) =
        Sum(   [inner product (k – L(k)) . . . Inner
          Product(k – L(k))] * [Cosine Window]   )
Mag Sq Sum Averaged(k) =
        Sum(   [Mag Sq Sum (k – L(k)) . . .
              Mag Sq Sum(k – L(k))] * [Cosine Window]   )
```

These functions form Cosine window-weighted averages of the inner product and magnitude square sum across frequency bins. The length of the Cosine window increases with frequency so that high frequency averages involve more adjacent frequency points then low frequency averages. The purpose of this averaging is to reduce the effects of spatial aliasing.

Spatial aliasing occurs when the wave lengths of signals arriving at the left and right ears are shorter than the space between the ears. When this occurs, a signal arriving from off-axis can appear to be perfectly in-phase with respect to the two ears even though there may have been a K*2*PI (K some integer) phase shift between the ears. Axis in "off-axis" refers to the centerline perpendicular to a line between the ears of the user; i.e., the forward direction from the eyes of the user. This spatial aliasing phenomenon occurs for frequencies above approximately 1500 Hz. In the real world, signals consist of many spectral lines, and at high frequencies these spectral lines achieve a certain density over frequency—this is especially true for consonant speech sounds—. If the estimate of directionality for these frequency points are averaged, an on-axis signal continues to appear on-axis. However, an off-axis signal will now consistently appear off-axis since for a large number of spectral lines, densely spaced, it is impossible for all or even a significant percentage of them to have exactly integer K*2*PI phase shifts.

The inner product average and magnitude squared sum average vectors are then passed from the band smoother 156 to the beam spectral subtract gain operation 158. This gain operation uses the two vectors to calculate a gain per frequency bin. This gain will be low for frequency bins, where the sound is off-axis and/or below a spectral subtraction threshold, and high for frequency bins where the sound is on-axis and above the spectral subtraction threshold. The beam spectral subtract gain operation is repeated for every frequency bin.

Figure 4:
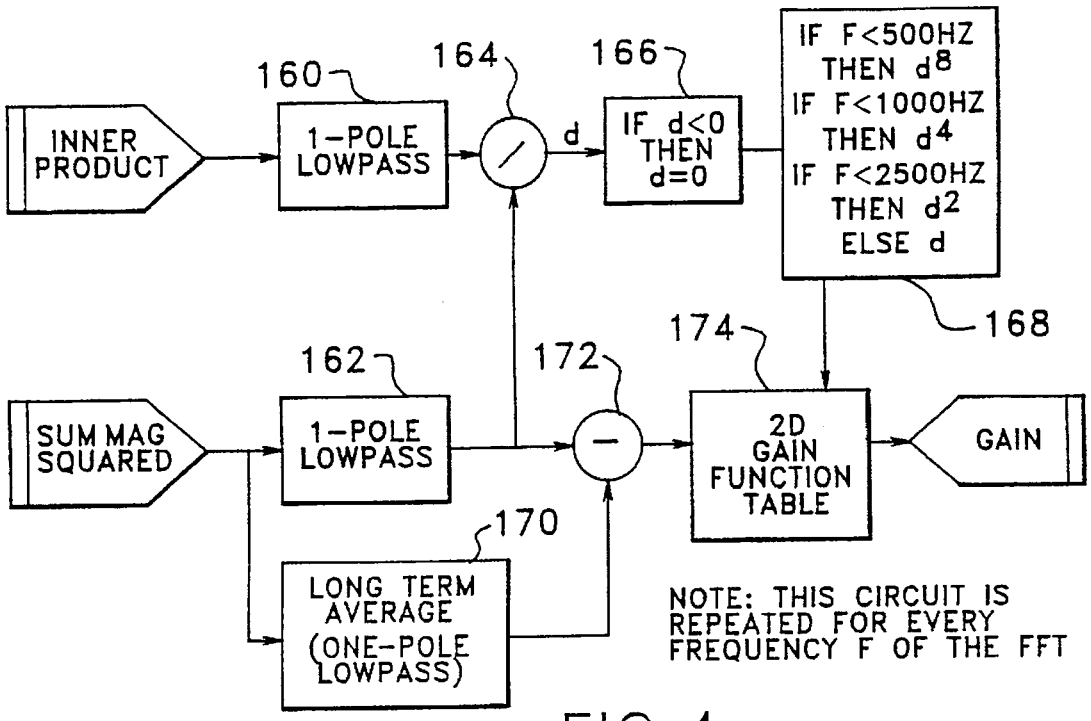
FIG. 4 shows the details of the beam spectral subtract gain operation 158 in FIG. 1.

The beam spectral subtract gain operation 158 in FIG. 1 is shown in detail in FIG. 4. The inner product average and magnitude square sum average for each bin are smoothed temporally using one pole filters 160 and 162 in FIG. 4. The ratio of the temporally smoothed inner product average and magnitude square sum average is then generated by operation 164. This ratio is the preliminary direction estimate "d" equivalent to:

d=Average ((Mag Left(k) * Mag Right(k) * cos(Angle Left(k)−Angle Right(k))/ Average( (Mag Sq Left+Mag Sq Right))

The ratio, or d estimate, is a smoothing function which equals 0.5 when the Angle Left=Angle Right and when Mag Left=Mag Right. That is, when the values for frequency bin k are the same in both the left and right channels. As the magnitude or phase angles differ, the function tends toward zero, and goes negative for PI/2<Angle Diff<3PI/2. For d negative, d is forced to zero in operation 166. It is significant that the d estimate uses both phase angle and magnitude differences, thus incorporating maximum information in the d estimate. The direction estimate d is then passed through a frequency dependent nonlinearity operation 168 which raises d to higher powers at lower frequencies. The effect is to cause the direction estimate to tend towards zero more rapidly at low frequencies. This is desirable since the wave lengths are longer at low frequencies and so the angle differences observed are smaller.

If the inner product and magnitude squared sum temporal averages were not formed before forming the ratio d, then the result would be excessive modulation from segment to segment resulting in a choppy output. Alternatively, the averages could be eliminated and instead the resulting estimate d could be averaged, but this is not the preferred embodiment. In fact, this alternative is not a good choice. By averaging inner product and magnitude squared sum independently, small magnitudes contribute little to the "d" estimate. Without preliminary smoothing, large changes in d can result from small magnitude frequency components and these large changes contribute unduly to the d average.

The magnitude square sum average is passed through a long-term averaging filter 170, which is a one pole filter with a very long time constant. The output from one pole smoothing filter 162, which smooths the magnitude square sum is subtracted at operation 172 from the long term average provided by filter 170. This yields an excursion estimate value representing the excursions of the short-term magnitude sum above and below the long term average and provides a basis for spectral subtraction. Both the direction estimate and the excursion estimate are input to a two dimensional lookup table 174 which yields the beam spectral subtract gain.

The two-dimensional lookup table 174 provides an output gain that takes the form shown in FIG. 5B. The region inside the arched shape represents values of direction estimate and excursion for which gain is near one. At the boundaries of this region, the gain falls off gradually to zero. Since the two-dimensional table is a general function of directionality estimate and spectral subtraction excursion estimate, and since it is implemented in read/write random access memory, it can be modified dynamically for the purpose of changing beamwidths.

The beamformed/spectral subtracted spectrum is usually distorted compared to the original desired signal. When the spatial window is quite narrow, then these distortions are due to elimination of parts of the spectrum which correspond to desired on-line signal. In other words, the beamformer/spectral subtractor has been too pessimistic. The next operations in FIG. 1, involving pitch estimation and calculation of a Pitch Gain, help to alleviate this problem.

Figure 6:
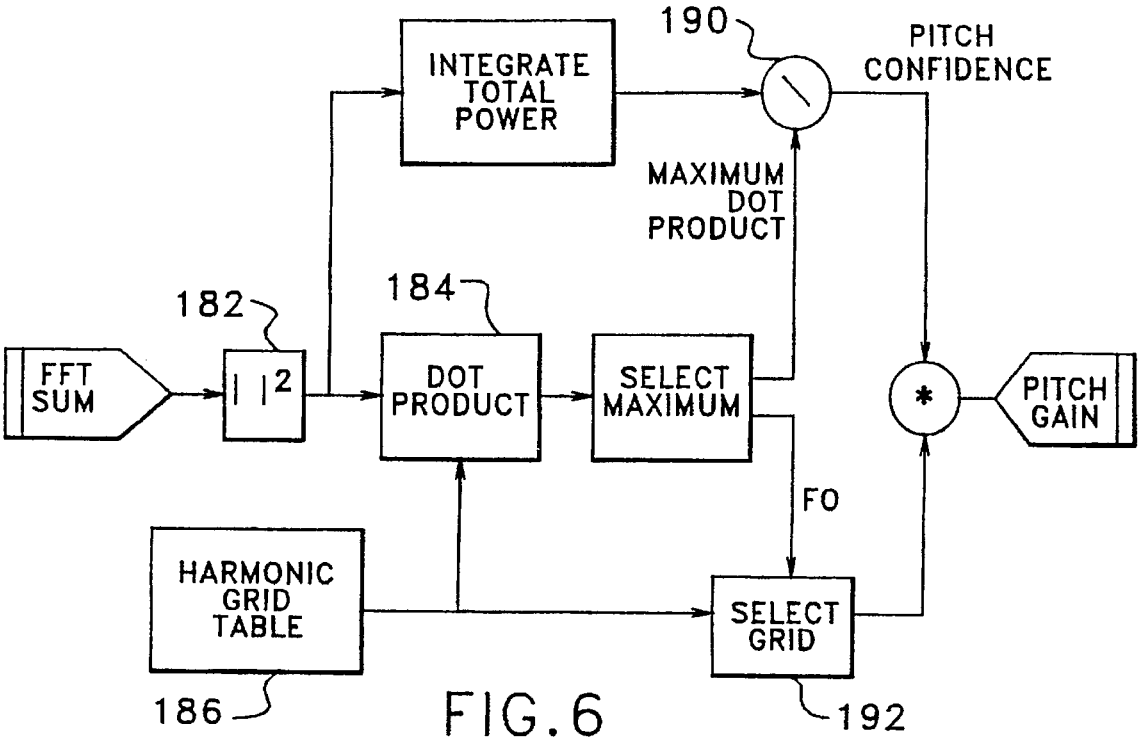
FIG. 6 shows the details of the pitch-estimate gain operation 180 in FIG. 1.

In FIG. 1, the complex sum of the left and right channel from FFTs 150 and 152, respectively, is generated at operation 176. The complex sum is multiplied at operation 178 by the beam spectral subtraction gain to provide a partially noise-reduced monaural complex spectrum. This spectrum is then passed to the pitch gain operation 180, which is shown in detail in FIG. 6.

The pitch estimate begins by first calculating, at operation 182, the power spectrum of the partially noise-reduced spectrum from multiplier 178 (FIG. 1). Next, operation 184 computes the dot product of this power spectrum with a number of candidate harmonic spectral grids from table 186. Each candidate harmonic grid consists of harmonically related spectral lines of unit amplitude. The spacing between the spectral lines in the harmonic grid determines the fundamental frequency to be tested. Fundamental frequencies between 60 and 400 Hz with candidate pitches taken at 1/24 of an octave intervals are tested. The fundamental frequency of the harmonic grid which yields the maximum dot product is taken as $F_0$, the fundamental frequency, of the desired signal. The ratio generated by operation 190 of the maximum dot product to the overall power in the spectrum gives a measure of confidence in the pitch estimate. The harmonic grid related to $F_0$ is selected from table 186 by operation 192 and used to form the pitch gain. Multiply operation 194 produces the $F_0$ harmonic grid scaled by the pitch estimate confidence measure. This is the pitch gain vector.

In FIG. 1, both pitch gain and beam spectral subtract gain are input to gain adjust operation 200. The output of the gain adjust operation is the final per frequency bin noise reduction gain. For each frequency bin, the maximum of pitch estimate gain and beam spectral subtract gain is selected in operation 200 as the noise reduction gain.

Since the pitch estimate gain is formed from the partially noise reduced signal, it has a strong probability of reflecting the pitch of the desired signal. A pitch estimate based on the original noisy signal would be extremely unreliable due to the complex mix of desired signal and undesired signals.

The original frequency domain left and right ear signals from FFTs 150 and 151 are multiplied by the noise reduction gain at multiply operations 202 and 204. A sum of the noise reduced signals is provided by summing operation 206. The sum of noise reduced signals from summer 206, the sum of the original non-noise reduced left and right ear frequency domain signals from summer 176, and the noise reduction gain are input to the voice detect gain scale operation 208 shown in detail in FIG. 7.

Figure 7:
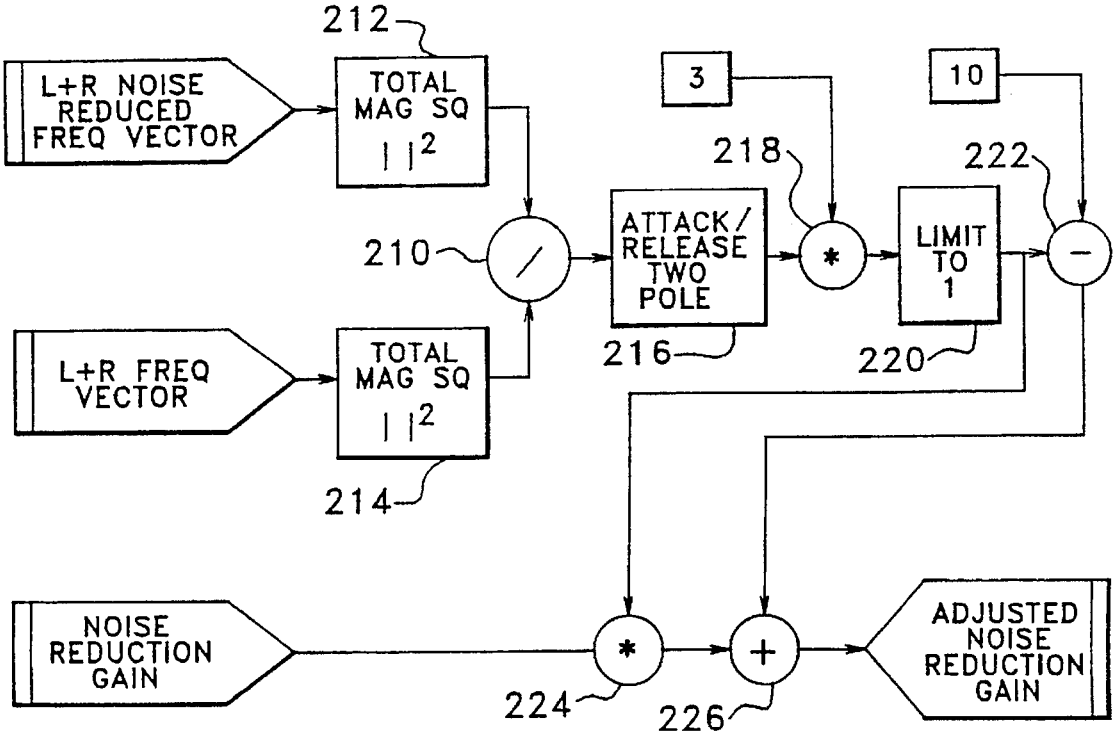
FIG. 7 shows the details of the voice detect gain scaling operation 208 in FIG. 1.

In FIG. 7, the voice detect gain scale operation begins by calculating, at operation 210, the ratio of the total power in the summed left and right noised reduced signals to the total power of the summed left and right original signals. Total magnitude square operations 212 and 214 generate the total power values. The ratio is greater the more noise reduced signal energy there is compared to original signal energy. This ratio (VoiceDetect) serves as an indicator of the presence of desired signal. The VoiceDetect is fed to a two-pole filter 216 with two time constants: a fast time constant (approximately 10 ms) when VoiceDetect is increasing and a slow time constant (approximately 2 seconds) when voice detect is decreasing. The output of this filter will move immediately towards unity when VoiceDetect goes towards unity and will decay gradually towards zero when VoiceDetect goes towards zero and stays there. The object is then to reduce the effect of the noise reduction gain when the filtered VoiceDetect is near zero and to increase its effect when the filtered VoiceDetect is near unity.

The filtered VoiceDetect is scaled upward by three at multiply operation 218, and limited to a maximum of one at operation 220 so that when there is desired on-axis signal the value approaches and is limited to one. The output from operation 220 therefore varies between 0 and 1 and is a VoiceDetect confidence measure. The remaining arithmetic operations 222, 224 and 226 scale the noise reduction gain based on the VoiceDetect confidence measure in accordance with the expression:

$$\text{Final Gain}=(G_{NR} * \text{Conf})+(1-\text{Conf}),$$ where: $G_{NR}$ is noise reduction gain, Conf is the VoiceDetect confidence measure.

In FIG. 1, the final VoiceDetect Scaled Noise Reduction Gain is used by multipliers 230 and 232 to scale the original left and right ear frequency domain signals. The left and right ear noise reduced frequency domain signals are then inverse transformed at FFTs 234 and 236. The resulting time domain segments are windowed with a sine window and 2:1 overlap-added to generate a left and right signal from window operations 238 and 240. The left and right signals are then passed through deemphasis filters 242, 244 to produce the stereo output signal. This completes the noise reduction processing stage.

While a number of preferred embodiments of the invention have been shown and described, it will be appreciated by one skilled in the art, that a number of further variations or modifications may be made without departing from the spirit and scope of my invention.

References Cited In Specification:

1. Evaluation of an adaptive beamforming method for hearing aids. J. Acoustic Society of America 91(3). Greenberg, Zurek.
2. Improvement of Speech Intelligibility in Noise: Development and Evaluation of a New Directional Hearing Instrument Based on Array Technology. Thesis from Delft University of Technology. Willem Soede
3. Multimicrophone adaptive beamforming for interference reduction in hearing aids. Journal of Rehabilitation Research and Development, Vol. 24 No. 4. Peterson, Durlach, Rabinowitz, Zurek.
4. Multimicrophone signal processing technique to remove room reverberation from speech signals. J. Acoustic Society of America 61. Allen, Berkley, Blauert.
5. An Alternative Approach to Linearly Constrained Adaptive Beamforming. IEEE Transactions on Antennas and Propagation. Vol. AP-30 NO. 1 Griffiths, Jim.
6. Microphone Array Speech Enhancement in Overdetermined Signal Scenarios. Proceedings 1993 IEEE International Conference on Acoustics, Speech, and Signal Processing. II-347. Slyh, Moses.
7. Gaik W., Lindemann W. (1986) Ein digitales Richtungsfilter baslerend auf der Auswertung Interauraler Parameter von Kunstkoppfsignalen. In: Fortschritte der Akustik-DAGA 1986.
8. Kollmeier, Hohmann, Peissig (1992) Digital Signal Processing for Binaural Hearing Aids. Proceedings, International Congress on Acoustics 1992, Beijing, China.
9. Bodden Proceedings, (1992) Cocktail-Party-Processing: Concept and Results. International Congress on Acoustics 1992, Beijing, China.
11. Nicolet Patent on spectral subtraction
12. Ephraim, Malah (1984) Speech enhancement using a minimum mean-square error short—time spectral amplitude estimator. IEEE Trans. Acoust., Speech, Signal Processing. 33(2):443–445, 1985.
13. Boll. (1979) Suppression of acoustic noise in speech using spectral subtraction. IEEE Trans. Acoust., Speech, Signal Processing. 27(2):113–120, 1979.
14. Gaik (1990): Untersuchungen zur binaurelen Verarbeitung kopfbesogener Signale. Fortschr.-Be. VDI Reihe 17 Nr. 63. Dusseldorf: VDI-Verlag.
15. Lindemann W. (1986): Extension of a binaural cross-correlation model by contralateral inhibition. I. Simulation of lateralization of stationary signals. JASA 80, 1608–1622.
16. Openheim and Schaefer. (1989) Discrete-Time Signal Processing. Prentice Hall.
17. Parsons (1976) Separation of speech from interfering speech by means of harmonic selection. JASA 60 911–918
18. Stubbs, Summerfield (1988) Evaluation of two voice-separation algorithms using normal-hearing and hearing-impaired listeners. JASA 84 (4) Oct. 1988
19. Jayant, Noll. (1984) Digital coding of waveforms. Prentice-Hall.
20. Crochiere, Rabiner. (1983) Multirate Digital Signal Processing. Prentice-Hall
21. Malvar (1992) Signal Processing With Lapped Transforms, Artech House, Norwood MAS, 1992
22. Vaidyanathan (1993) Multirate Systems and Filter Banks, Prentice-Hall
23. Daubauchies (1992) Ten Lectures On Wavelets, SIAM CBMS seties, April 1992

What is claimed is:

1. Apparatus for reducing noise in a binaural hearing aid having left and right audio signals comprising:

means for converting the left and right audio signals into left and right digital audio data;

beamforming means responsive to left and right digital audio data for generating a beamforming noise reduction gain for both the left and right audio signals;

pitch means responsive to the left and right digital audio data and the beamforming noise reduction gain for providing a pitch estimate gain; and applying means for combining the beamforming noise reduction gain and the pitch estimate gain to produce a noise reduction gain and for applying the noise reduction gain to the left and right digital audio data.

2. The apparatus of claim 1 and in addition:

means responsive to the left and right digital audio data for detecting desired audio data present in the left and right digital audio data;

means responsive to said detecting means for generating a gain scaler as a measure of the presence of desired audio data; and means responsive to said gain scaler for scaling the noise reduction gain applied to the left and right digital audio data by said applying means.

3. The apparatus of claim 1 wherein said beamforming means comprises:

means for detection audio directionality from the left and right audio frequency domain data to produce a direction estimate;

means for determining the short-term magnitude deviation of the left and right audio frequency domain data from long-term magnitude average to produce an excursion estimate; and means responsive to the direction estimate and the excursion estimate for producing the beamforming noise reduction gain.

4. The apparatus of claim 3 wherein said pitch means comprises:

means for modifying the left and right audio frequency domain data in proportion to the beamforming noise reduction gain to produce a noise reduced audio spectrum;

means for estimating a fundamental pitch frequency from the noise reduced audio spectrum and for producing a pitch confidence measure; and means responsive to the pitch confidence measure for generating the pitch estimate gain.

5. In a binaural hearing aid system having left and right audio time domain signals, apparatus for reducing noise in the left and right audio signals comprising:

audio signal analyzer for analyzing the left and right audio signals into left and right audio frequency domain vectors;

a signal encoder for applying signal encoding techniques to the left and right audio frequency domain vectors based on signal cues derived from the left and right audio frequency domain vectors to provide a noise reduction gain vector, the signal cues include a directionality value and varying as a function of frequency with each frequency component in the left and right audio frequency domain vectors;

gain control for adjusting the left and right audio frequency domain vectors with the noise reduction gain vector to reduce the noise in the left and right audio frequency domain vectors; and audio signal synthesizer for synthesizing left and right audio time domain signals from the noise reduced left and right audio frequency domain vectors.

6. The system of claim 5 wherein the signal cues in said signal encoder also include short term amplitude deviation from long term average.

7. The apparatus of claim 6 wherein said signal encoder comprises:

direction estimator for estimating directionality for each frequency component in the left and right audio frequency domain vectors from the magnitude and phase angle differences between the left and right audio frequency domain vectors;

standard deviation detector for determining a standard deviation from a long term average for the sum of magnitudes squared for each frequency component in the left and right audio frequency domain vectors;

gain vector generator for generating a beam spectral subtract gain vector from the directionality and the standard deviation, the beam spectral subtract gain vector being used by said signal encoder to provide the noise reduction gain vector.

8. The apparatus of claim 7 and in addition:

right and left audio vector summer for combining the right and left audio frequency domain vectors into a monaural vector;

audio power spectrum vector generator for combining the monaural vector with the beam spectral subtract gain vector to produce an audio power spectrum vector;

pitch estimate gain vector generator for generating a pitch estimate gain vector based on the power spectrum vector; and said signal encoder selecting frequency components for the noise reduction gain vector from the beam spectral gain vector and the pitch estimate gain vector.

9. The apparatus of claim 8 and in addition:

gain scaler generator for generating a gain scaler as a measure of desired audio signals being present in the left and right audio frequency domain vectors;

noise reduction gain control responsive to said gain scaler for scaling the noise reduction gain applied to the left and right audio frequency domain vectors by said signal encoder.

10. Noise reduction apparatus for a binaural hearing aid having left and right audio signals, said apparatus comprising:

means for converting the left and right audio signals into left and right digital audio vectors;

beamforming means responsive to left and right digital audio vectors for generating a beamforming vector for both the left and right audio vectors;

said beamforming means having inner product means, magnitude square summing means, smoothing means and gain means;

said inner product means for producing an inner product vector based on the amplitude of and phase difference between the left and right digital audio vectors;

said magnitude square summing means producing magnitude squared vector based on the combined power in the left and right digital audio vectors;

said smoothing means for smoothing the inner product vector and the magnitude squared vector to average the left and right digital audio vectors;

said gain means responsive to the smoothed inner product vector and the smoothed magnitude squared vector for generating the beamforming vector based on the amplitude, phase and power of the left and right digital audio vectors; and means for applying at least the beamforming vector to the left and right digital audio vectors to reduce the noise in the left and right digital audio vectors.

11. The apparatus of claim 10 and in addition:

pitch means responsive to the left and right digital audio vectors and the beamforming vector for providing a pitch estimate vector; and said applying means combining the beamforming vector and the pitch estimate vector to produce a noise reduction vector and applying the noise reduction gain vector to the left and right digital audio vectors.

12. The apparatus of claim 11 wherein said smoothing means smoothes the inner product vector and the magnitude squared vector over time.

13. The apparatus of claim 10 wherein said smoothing means smoothes the inner product vector and the magnitude squared vector over time.

14. The apparatus of claim 13 wherein said smoothing means also smoothes the inner product vector and the magnitude squared vector across frequency bands.

* * * * *